US005916036A

United States Patent [19]

Hamilton

[11] Patent Number: 5,916,036

[45] Date of Patent: Jun. 29, 1999

[54] WEIGHT SHIFT MONITOR FOR GOLFERS

[76] Inventor: David Paul Hamilton, 113 Cowden St., Shannon, Mich. 38868

[21] Appl. No.: 09/073,455

[22] Filed: May 6, 1998

Related U.S. Application Data

[60] Provisional application No. 60/045,663, May 6, 1997.

[51] Int. Cl.[6] ..... A63B 69/36

[52] U.S. Cl. ..... 473/269; 473/409

[58] Field of Search ..... 473/269, 409

[56] References Cited

U.S. PATENT DOCUMENTS

| | | | |
|---|---|---|---|
| 3,352,559 | 11/1967 | Larson . | |
| 3,415,523 | 12/1968 | Boldt . | |
| 3,639,923 | 2/1972 | Stewart . | |
| 4,023,810 | 5/1977 | Lorang . | |
| 4,037,847 | 7/1977 | Lorang | 473/269 |
| 4,088,325 | 5/1978 | Sutton | 473/269 |
| 4,917,385 | 4/1990 | Brown . | |
| 5,000,457 | 3/1991 | Brown . | |
| 5,263,863 | 11/1993 | Stefani et al. . | |

*Primary Examiner*—George J. Marlo
*Attorney, Agent, or Firm*—John V. Stewart

[57] ABSTRACT

A flat horizontal platform (2) mounted on a base (1) by a central board (4) between the two. The central board (4) is attached to the platform, and is bracketed by retainer boards (3*a*, 3*b*) attached to the base. A golfer stands on the platform addressing a ball in front of the platform. The platform tilts left or right about the respective left or right side of the center board if the golfer's center of weight shifts beyond the respective left or right side of the enter board. A clicker between the base and platform on the back-swing side, alerts the golfer to an improper weight shift toward the back-swing, providing feedback during training to eliminate this stroke motion error.

13 Claims, 3 Drawing Sheets

WEIGHT SHIFT MONITOR FOR GOLFERS

CROSS-REFERENCE TO RELATED APPLICATIONS

This application claims the benefit of U.S. Provisional Application No. 60/045,663, filed May 6, 1997.

BACKGROUND OF THE INVENTION

1. Field of the Invention

This invention is in the field of weight-shift monitors and analyzers for golf swing practice.

2. Description of Prior Art

Numerous golf stance and movement aids are shown in prior patents, including weight shift monitoring devices of various types. However, none provide the same training feedback as the present invention, and none have achieved its simplicity and effectiveness. Relevant U.S. patents in this field include U.S. Pat. No. 2,189,613 (Paulsen), U.S. Pat. No. 3,352,559 (larsen), U.S. Pat. No. 3,415,523 (Boldt), U.S. Pat. No. 3,639,923 (Stewart), U.S. Pat. No. 4,023,810 (Lorang), U.S. Pat. No. 5,263,863 (Stefani), and U.S. Pat. No. 4,917,385 (Brown).

U.S. Patent 3,352,559 (Larsen) shows a Golf Swing Training Device having a platform mounted on a universally rotatable ball, which allows the platform to tilt in any direction. A stop (18) on the follow-through side limits the platform to a horizontal position in that direction. A shorter stop (20) on the back-swing side allows the platform to tilt in that direction when the Wolfer's weight shifts laterally past the center, which is the error condition. The golfer is thus trained to center his or her weight toward the follow-through side, rather than over the center as with the present invention. Larsen's platform also tilts forward and back, and has respective stops to indicate an error in the forward direction. Electrical contacts are provided to activate an electrical sound generator on each error condition.

U.S. Patent 5,263,863 (Stefani) shows a Weight Shift Trainer for Golfers having two individual foot platforms mounted oh a base. The foot platform on the follow-through side pivots between a horizontal position and an inward-facing position to allow the user to sense a shift of weight via the angle of the leading foot.

U.S. Patent 3,415,523 (Boldt) shows a golfer's Training Device for guiding every aspect of a golfer's swing and stance, and monitoring the golfer's center of weight. The weight monitoring portion comprises a platform (30) mounted on a central pivot point, and stabilized horizontally by springs (34) at the left and right sides between the platform and base (26). A pair of electrical contacts (36 and 38) are provided between the platform and base on thy follow-through side. These contacts are used in conjunction with other switches to train the golfer to shift his or her weight to the back-swing foot on the back-swing, and to the follow-through foot on the follow-through. In contrast, the present invention warns the golfer against shifting the weight toward the back-swing. Boldt's alert timing depends on the golfer's weight. The platform pivots about a single point and is balanced by springs, so a heavier golfer will close the contacts at a smaller distance off-center than will a light golfer. In contrast, the alert timing in the present invention depends only on the distance that the golfer's weight is off center, regardless of the weight of the golfer.

SUMMARY OF THE INVENTION

The objectives of the present invention) are provision of a simple, effective weight shift detector and alert for golf swing practice, that is sensitive only to a given distance of lateral shift in a golfer's weight off center, is independent of the golfer's absolute weight, and audibly warns the golfed of a shift toward the back swing, and optionally the follow-through, without electronics.

These objectives are achieved by a flat horizontal platform (2) mounted on a base (1) by a central board (4) between the two. The central board (4) is attached to the platform, and is bracketed by retainer boards (3*a*, 3*b*) attached to the base. A golfer stands on the platform addressing a ball in front of the platform. The platform tilts left or right about the respective left or right side of the center board if the golfer's center of weight shifts beyond the respective left or right side of the center board. A clicker between the base and platform on the back-swing side, alerts the golfer to an improper weight shift toward the beck-swing, providing feedback during training to eliminate this stroke motion error.

DRAWINGS

REFERENCE NUMERALS

Figure 1:
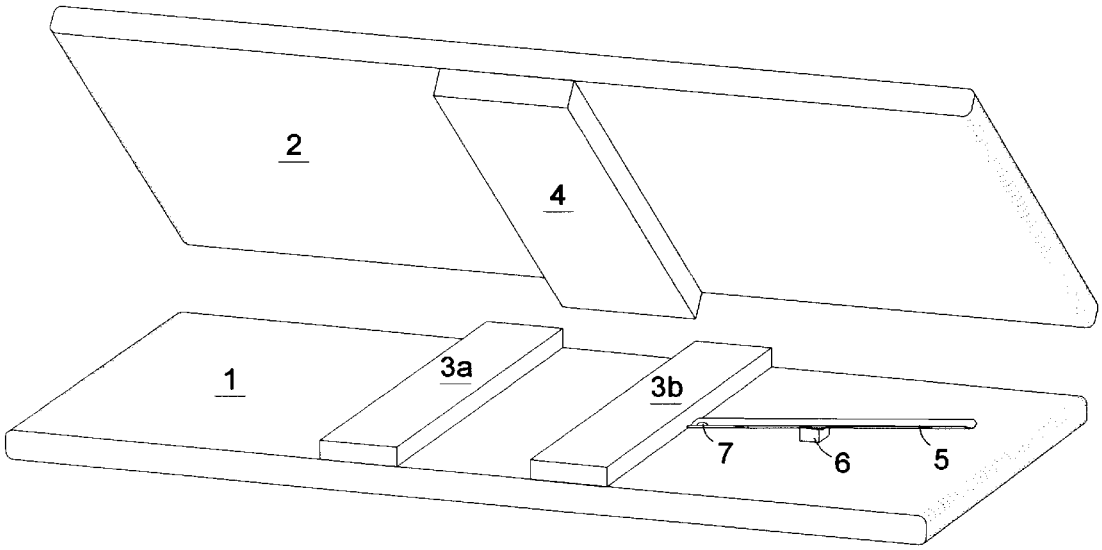
FIG. 1 Shows an open view of the too and bottom boards of the monitor, to disclose the inner structure.

1. Bottom board or base
2. Top board or platform
3*a*. First bracket strip or retainer strip
3*b*. Second bracket strip or retainer strip
4. Center board
5. Clicker
6. Clicker middle support
7. Clicker attachment screw
8. Left foot placement label
9. Right foot placement label
11. Optional tilt stop
12. Center line

DESCRIPTION

This invention provides golfers with means to learn ideal body balance during a golf swing. It provides audible feedback when the body moves off center on the back-swing. FIG. 1 shows the construction of the device, which comprises a bottom board (1) and a top board (2), with a center board (4) attached centrally and transversely to the underside of the top board. The center board is bracketed between bracket strips (3*a*, 3*b*) which are attached to the top side of the bottom board. A clicker (5) is attached to the top side of the bottom board, on the right (shown) or left (not shown) to monitor a right-handed or left-handed golf swing respectively. The preferred dicker is a strip of spring steel with curvature for rigidity, as is commonly used for tape measures, but any practical sound generator may be used.

Figure 2:
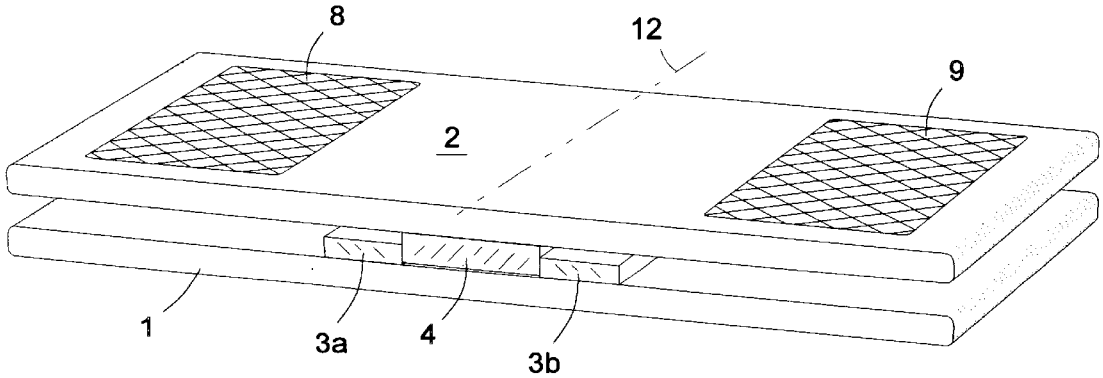
FIG. 2 Shows an assembled perspective view.
Figure 3:
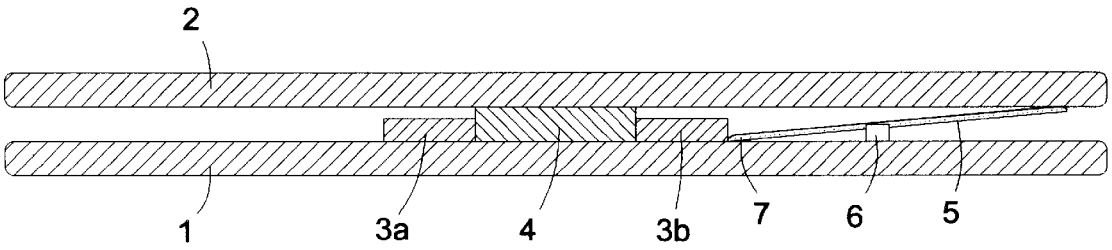
FIG. 3 Shows a front view with the boards parallel, as when the golfer is balanced.
Figure 4:
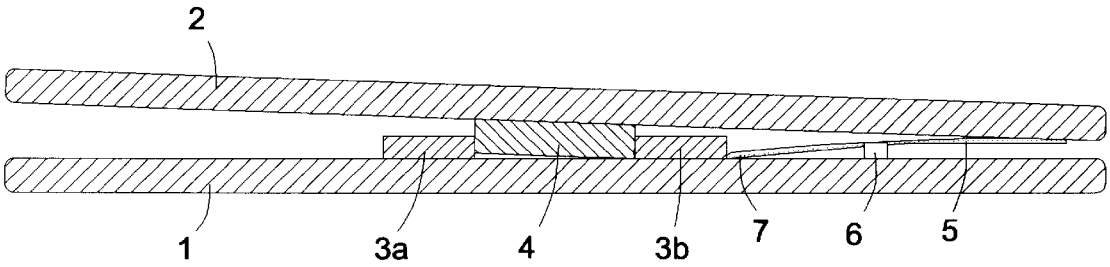
FIG. 4 Shows a front view with the top board tipped right and the clicker bent, indicating an improper weight shift for a right-handed golfer.

FIGS. 2 and 3 show that the bracket strips (3*a*, 3*b*) may have less vertical thickness than the center board (4), allowing the top board to rock or tilt left and right on the left and right sides of the center board respectively as a fulcrums. In this preferred embodiment, the bracket strips should allow the top board to tilt until the clicker sounds, as shown in FIG. 3. Optionally, the bracket strips may be at least the same height at the center board, causing the right and left tilt fulcrums to be respectively the right side of the right bracket strip and the left side of the left bracket strip.

Figure 5:
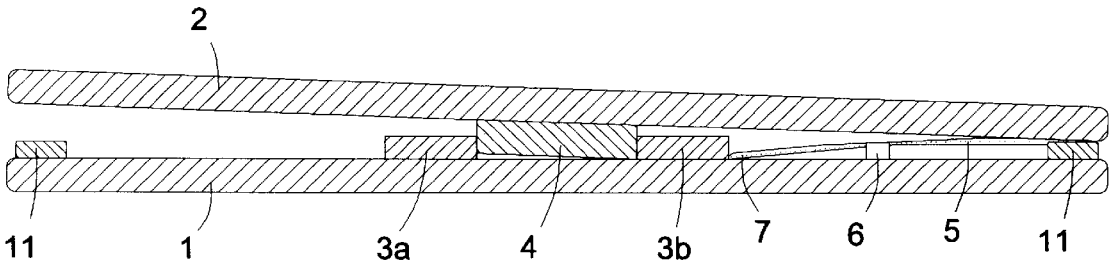
FIG. 5 Shows the same view as FIG. 4, with optional tilt stops (11).
Figure 6:
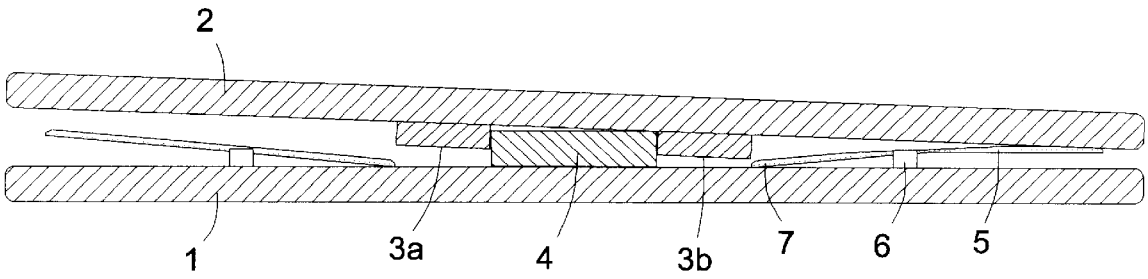
FIG. 6 Shows an alternate embodiment with the center board attached to the base, and having a left and right clicker.
Figure 7:
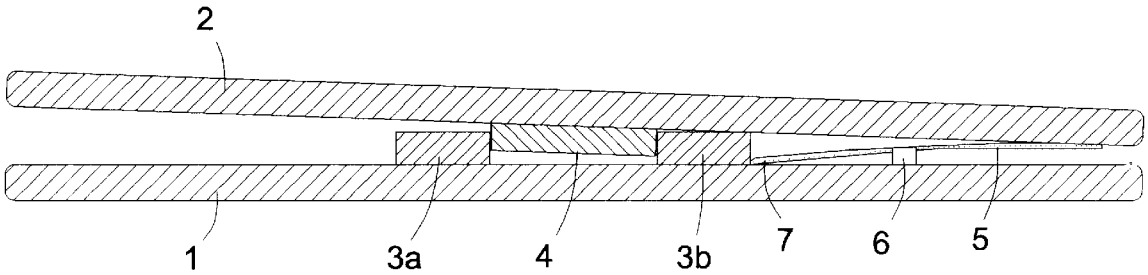
FIG. 7 Shows an alternate embodiment with the bracket strips taller than the center board.
Figure 8:
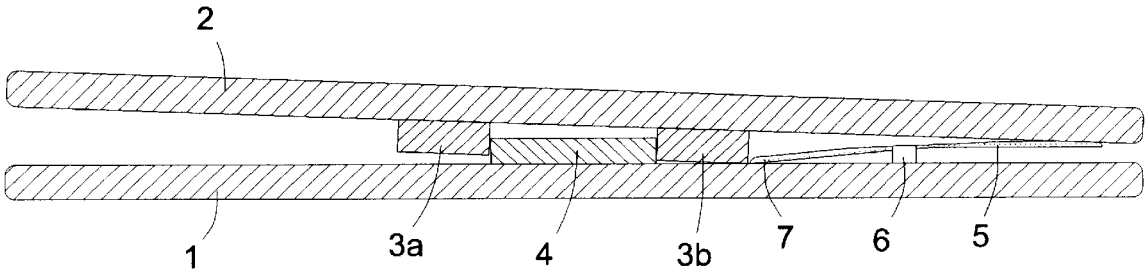
FIG. 8 Shows an alternate embodiment wits the center board attached to the base and the bracket strips taller than the center board.

Primary stability of the top board is determined by the width of the center board and the closeness of fit of the center board between the bracket strips. This stability determines how soon and how quickly the top board tilts. Tilt limits can be optionally provided via stops (11) as shown in FIG. 5. These stops may be fixed, or may comprise screws of adjustable height in order to set an ideal stopping point just after the clicker sounds. An intermediate level of stability can be provided by the height and width of the bracket strips, such that the top board contacts the upper outer edge of strip (3*a*) after the clicker sounds. For simplicity the preferred embodiment does not have stops (11).

To use this weight-shift monitor, a golfer stands on the top board with his or her feet placed approximately on the foot placement labels (8 and 9). The golfer assumes a golf swing address stance, with or without a dub in hand, and the swing motion is practiced until no clicking is produces. This eliminates weight shift of the body toward the back-swing. Weight shift toward the follow-through is allowed, since no clicker is provided on that side. A dicker may optionally be provided on the follow-through side - preferably one that produces a different sound.

The attachment sites of the center board (4) and bracket strips (3*a*, 3*b*) may be inverted, such that the center board is attached to the top side of the bottom board, and the bracket strips are attached to the underside of the top board. However, the preferred arrangement of these parts is as shown in FIGS. 1–5. It is best to mount the clicker on the bottom board. This allows for left-handed reversal of the clicker as next described, while keeping the clicker adjacent a bracket strip for protection.

For a left-handed golf swing, the bottom board is turned around so that the clicker is on the golfer's left. The top board may be dismounted from the bottom board and re-mounted on the reversed bottoms board. This relative reversal of the boards is preferred for left-handed use, since any labeling on the top board will remain readable to the golfer. For temporary left-handed use, the whole device may be simply turned around.

Support of the platform by a flat, elongated, horizontal center board, and/or parallel bracket strips (depending on the relative heights of the center board and bracket strips), is geometrically the same as supporting the platform along two parallel lines of support, one on each site of the center line. Thus, the centerboard may be replaced with two parallel support rails which support the platform. Each of the rails defines the limit of platform tilt stability on its respective side of the center line (12). The rails need not be continuous but may by replaced by 4 point supports. However, a centerboard as shown is preferred over narrow rails or point supports, since a flat board distributes the weight of the platform over an area, and is simpler.

Although the present invention has been described herein with respect to preferred embodiments, it will be understood that the foregoing description is intended to be illustrative, not restrictive. Modifications of the present invention will occur to those skilled in the art. All such modifications which fall within the scope of the appended claims are intended to be within the scope and spirit of the present invention.

I claim:

1. A weight shift monitor for golfers, comprising;

a base;

a flat, horizontal platform having a back-swing side, a follow-through side, and a longitudinal center line substantially equidistant from respective points on the two sides;

an elongated, flat, horizontal center board mounted along the center line, between the base and the platform;

the center board having a back-swing side that provides a line of support and pivot axis for the platform on the back-swing side of the center line when the platform is tilted downward on the back-swing side of the center line;

the center board having a follow-through side that provides a line of support and pivot axis for the platform on the follow-through side of the center line when the platform is tilted downward on the follow-through side Of the center line;

means for retaining the platform on the base; and a first pressure sensitive sound generator mounted between the base and the platform on the back-swing side for producing an audible alert when the platform is tilted downward toward the base on the back-swing side;

whereby a golfer can stand on the platform, and the platform will remain horizontal as long as the golfer's weight is approximately centered laterally over the center line of the platform, and if the golfers center of weight shifts laterally beyond the line of support on the back-swing side, the platform will tilt, and the first sound generator will produce an alert.

2. The weight shift monitor of claim 1, wherein the center board has a width in the range of approximately 70 mm to 130 mm (2.7 to 5.1 in.).

3. The weight shift monitor of claim 2, wherein the center board is attached to the platform, and further including a bracket attached to the base on each side of the centerboard for retaining the centerboard and platform in a laterally centered position above the base.

4. The weight shift monitor of claim 2, wherein the center board is attached to the base, and further including a bracket attached to the platform on each side of the centerboard for retaining the platform in a laterally centered position above the base.

5. The weight shift monitor of claim 1, further including a second pressure sensitive sound generator mounted between the base and the platform on the follow-through side for producing an audible alert when the platform is tilted downward toward the base on the follow-through side; the second sound generator having a different pitch than the first sound generator.

6. A weight shift monitor for golfers, comprising;

a base;

a flat, horizontal platform having a back-swing side, a follow-through side, and a longitudinal center line substantially equidistant from respective points on the two sides;

an elongated, flat, horizontal center board mounted along the center line, between the base and the platform, having back-swing and follow-through sides;

a back-swing bracket strip and a follow-through bracket strip mounted between the base and the platform, closely along the back-swing and follow-through sides of the centerboard respectively, for retaining the centerboard between the bracket strips;

a first pressure sensitive sound generator mounted between the base and the platform on the back-swing side for producing an audible alert when the platform is tilted downward toward the base on the back-swing side;

whereby a golfer can stand on the platform, and the platform will remain horizontal while the golfer's weight is approximately centered laterally over the center line of the platform, but if the golfer's center of weight shifts laterally a given amount, the platform will tilt, and if tilted on the back-swing side, the first sound generator will produce an alert.

7. The weight shift monitor of claim 6, wherein the center board has a width in the range of approximately 70 mm to 130 mm (2.7 to 5.1 in.).

8. The weight shift monitor of claim 7, wherein the center board is attached to the platform, and the bracket strips are attached to the base.

9. The weight shift monitor of claim 7, wherein the center board is attached to the base, and the bracket strips are attached to the center board.

10. The weight shift monitor of claim 6, wherein the center board is taller than the bracket strips.

11. The weight shift monitor of claim 6, wherein the bracket strips are at least as tall as the center board.

12. The weight shift monitor of claim 6, further including a second pressure sensitive sound generator mounted between the base and the platform on the follow-through side for producing an audible alert when the platform is tilted downward toward the base on the follow-through side; the second sound generator having a different pitch than the first sound generator.

13. A method for training a golf swing by using a weight shift monitor comprising:

a platform having a back-swing side, a follow-through side, and a center line equidistant between respective points on the two sides, the platform balanced on a flat, elongated, horizontal centerboard approximately laterally centered along the centerline below the platform; and, a clicker which sounds when the golfer's weight shifts toward the back-swing side;

the method comprising the steps of:

a golfer standing on the platform with his body approximately centered above the centerline;

the golfer practicing the motion of a golf driving stroke; and, the golfer modifying his stroke motion if necessary to eliminate the sound of the clicker;

whereby the golfer is trained to avoid shifting his weight toward the back-swing side of the driving stroke.

* * * * *